US005984130A

United States Patent [19]

Hayes et al.

[11] Patent Number: 5,984,130

[45] **Date of Patent: *Nov. 16, 1999**

[54] CATERING CONTAINER ASSEMBLY

[75] Inventors: Thomas J. Hayes, Wauconda; Thomas T. Taber, Park Ridge; Michael J. A. Sagan, Batavia, all of Ill.

[73] Assignee: Tenneco Packaging Inc., Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/514,534

[22] Filed: Aug. 14, 1995

[51] Int. Cl.[6] ..... B65D 43/08

[52] U.S. Cl. ..... 220/574; 206/508; 206/557; 220/780; 220/793

[58] Field of Search ..... 206/508, 509, 206/541, 546, 549, 557; 220/306–308, 352–358, 410, 574, 574.1, 575, 556, 669, 670–675, 780–783, 784, 791–793

[56] References Cited

U.S. PATENT DOCUMENTS

| | | | |
|---|---|---|---|
| D. 214,132 | 5/1969 | Niemoller | D9/431 |
| D. 255,857 | 7/1980 | Zimmermann | D11/143 |
| D. 256,308 | 8/1980 | Zimmermann | D11/143 |
| D. 256,646 | 9/1980 | Painter et al. | D7/542 |
| D. 259,774 | 7/1981 | Criscitiello, Jr. | D11/143 |
| D. 269,323 | 6/1983 | Cillario | D9/430 |
| D. 298,000 | 10/1988 | Ritman | D7/584 |
| D. 298,304 | 11/1988 | Meyer | D7/584 |
| D. 340,882 | 11/1993 | Holtkamp, Jr. | D11/143 |
| 2,773,624 | 12/1956 | Knieriem et al. | 220/675 |
| 3,344,974 | 10/1967 | Bostrom | 220/675 |
| 3,420,431 | 1/1969 | Donovan | 220/669 |
| 4,753,351 | 6/1988 | Guillin | 220/307 |
| 4,844,263 | 7/1989 | Hadtke | 206/508 |
| 4,947,993 | 8/1990 | Bruml et al. | 220/574.1 |
| 5,048,707 | 9/1991 | Hallberg | 220/671 |
| 5,065,889 | 11/1991 | Conti | 220/574 |
| 5,269,430 | 12/1993 | Schlaupitz et al. | 220/306 |
| 5,429,833 | 7/1995 | Wyslotsky | 220/306 |

FOREIGN PATENT DOCUMENTS

| | | | |
|---|---|---|---|
| 1 071 126 | 2/1980 | Canada | 190/26.6 |
| 1 076 044 | 4/1980 | Canada | 190/26.6 |
| 1 249 231 | 1/1989 | Canada | 190/35.5 |
| 397802 | 5/1909 | France | D7/549 |
| 39 43 301 C2 | 12/1989 | Germany . | |

OTHER PUBLICATIONS

BonFaire Disposable Food Service Products Brochure. ©Bon Faire by Placon Corporation, 1990.

*Plastics Engineering*, Oct. 1989, p. 10, illustratingBonFaire Microwaveable Packaging by Placon Corporation.

Multisided Dish, Thomas Festival Premiere in Harragate, Tableware InternationalJul. /1984 p. 8 (D7/505).

Ultra Pac, Inc. Brochure regarding Eco*Clear (Date unknown).

Gourmet Display Product Catalog, and in particular, pp. 10, 22–23 (Date unknown).

Transparent Cover with Transparent Container (Exhibit#1, correspondingto Figs. A & B) (Date unknown).

Metal Foil Container (Exhibit#2, corresponding to Figs. C & D) (Date unknown).

Transparent Cover with Opaque Container from Tray–Pak of Reading, PA (Exhibit#3, corresponding to Figs. E & F) (Date unknown).

*Primary Examiner*—Jimmy G. Foster

*Attorney, Agent, or Firm*—Arnold White & Durkee

[57] ABSTRACT

A catering container assembly for storing, transporting, and presenting food is presented having a tray and a domed cover. The tray has a base and side walls extending upwardly from said base. The domed cover has a top and cover walls extending downwardly from said top. The tray has a plurality of recessed platforms disposed adjacent its side walls while the domed cover has a plurality of indentations adjacent its cover walls. Each indentation abuts a respective one of the recessed platforms for transferring a force from the domed cover into said tray. Both the tray and domed cover preferably have stiffening elements joining and strengthening the side walls and cover walls, respectively. The tray is preferably hexagonal to allow for modular positioning. A bowl similar to the tray is also presented which has longer side walls for containing more food.

77 Claims, 15 Drawing Sheets

CATERING CONTAINER ASSEMBLY

FIELD OF THE INVENTION

The present invention relates generally to a high-strength, modular catering container assembly. More particularly, the invention relates to a catering tray, catering bowl and a domed cover.

BACKGROUND OF THE INVENTION

Catering containers have long been employed to store and transfer food prior to presenting the food to those persons who will consume it. Generally, a caterer loads the food onto the catering containers after preparation and stores the containers until the time at which the food is to be presented to consumers. The caterer then transfers the food from its preparation location to a dining location. To achieve the best results, it is most desirable to utilize catering containers on which food is easily loaded, stored, transported, and presented to the consumer while maintaining the integrity of the food.

Most catering containers have easy loading capability since they are flat and circular. The flat tray is then covered with a lid until presentation. However, flat circular containers can be difficult to store and present since horizontally adjacent containers abut each other at their circular periphery which leaves a gap, and therefore, requires additional surface area. Containers with rectangular-shaped profiles abut against each nicely and eliminate the gap. But, rectangular-shaped containers deviate from the traditional circular catering containers and are less aesthetically pleasing. Moreover, circular containers are preferable since they have a greater ability to distribute food in all directions.

Numerous catering containers are often stacked vertically to use less space in storage. However, this requires a structurally sound container and lid assembly such that the containers on the bottom are not crushed under the weight of those at the top. The lid must evenly transfer the vertical forces to the container through an interlocking mechanism between the lid and the container. Additionally, as the height of the stack increases, the stability of the stack decreases such that those on top may slide out of alignment and fall from the stack. This stacking stability problem is accentuated when a stack of containers is being manually transported by the caterer.

The container must also be strong enough to carry its contents. Not only is the static holding strength important, but the resistance to dynamic torsional and bending stresses is critical since the container must not become contorted during handling and transportation. If the containers are made of metal or ceramic, the issue of strength becomes secondary. But, many catering containers today are made of less costly polymers which brings the strength issue to the forefront.

The aesthetical presentment of the contents of the catering container is also essential. It is most desirable to have a translucent lid such that the contents are revealed without removing the lid. Not only is translucency essential during presentation to the consumers, but it is also beneficial to the caterer in that he or she knows which containers hold which foods. Translucency is easily accomplished when the lid is a polymer. But, to produce a strong polymeric lid, manufacturers have resorted to lids with a series of structural ribs. However, these structural ribs greatly detract from the translucency of the lid, and therefore, the presentability of the catering container.

A need therefore exists for an aesthetically pleasing catering container assembly which overcomes the aforementioned shortcomings associated with horizontal assembly presentation, vertical stacking, and structural stability.

SUMMARY OF THE INVENTION

Briefly, the present invention is directed to a new and improved catering container assembly. More particularly, the present invention relates to a structurally sound polymer tray and bowl which interlock with a structurally sound polymer domed cover.

One object of the invention is catering assembly modularity. This is achieved by having a hexagonal periphery on the tray and cover to allow for the horizontal arrangement of multiple catering assemblies on a table. The hexagonal shape allows for the juxtaposition of all catering assemblies while leaving only a minimal gap.

The present invention also provides for a mechanism between the cover and the tray which adequately transmits forces from the cover into the tray. Indentations on the lower portion of the cover engage recessed platforms on the tray for transferring the vertical force load from the cover onto the tray. Additionally, the domed cover has arc shaped cover walls for transferring the forces which reduce the stress concentrations associated with sharp corners. The arc shape also resists lateral forces directed into the cover walls.

Stiffening elements are also provided in the present invention to strengthen the tray and the cover. Bar stiffeners join adjacent side walls which extend around the periphery of the tray. Similar structures are present on the domed cover which eliminates the need for structural ribs and, therefore, provides for substantial viewing clarity into the catering assembly. These stiffening elements on the tray and cover resist the torsional and bending stresses which the assembly undergoes during storage and transportation.

In another embodiment, the tray is replaced by a bowl with a periphery substantially similar to that of the tray but having a deeper bottom for holding liquids. Structural elements similar to those existing on the tray are also present in the bowl. As with the tray, the domed cover is used to cover the contents of the bowl. Furthermore, the surfaces providing depth to the bowl are inwardly arced to transfer the vertical forces along that surface and resist the force from the food it contains.

Additionally, a stacking engagement mechanism between the cover of one catering assembly and the tray or bowl of another catering assembly is also provided. The stacking engagement mechanism minimizes the tendency of stacked catering assemblies to slide across each other.

The above summary of the presented invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
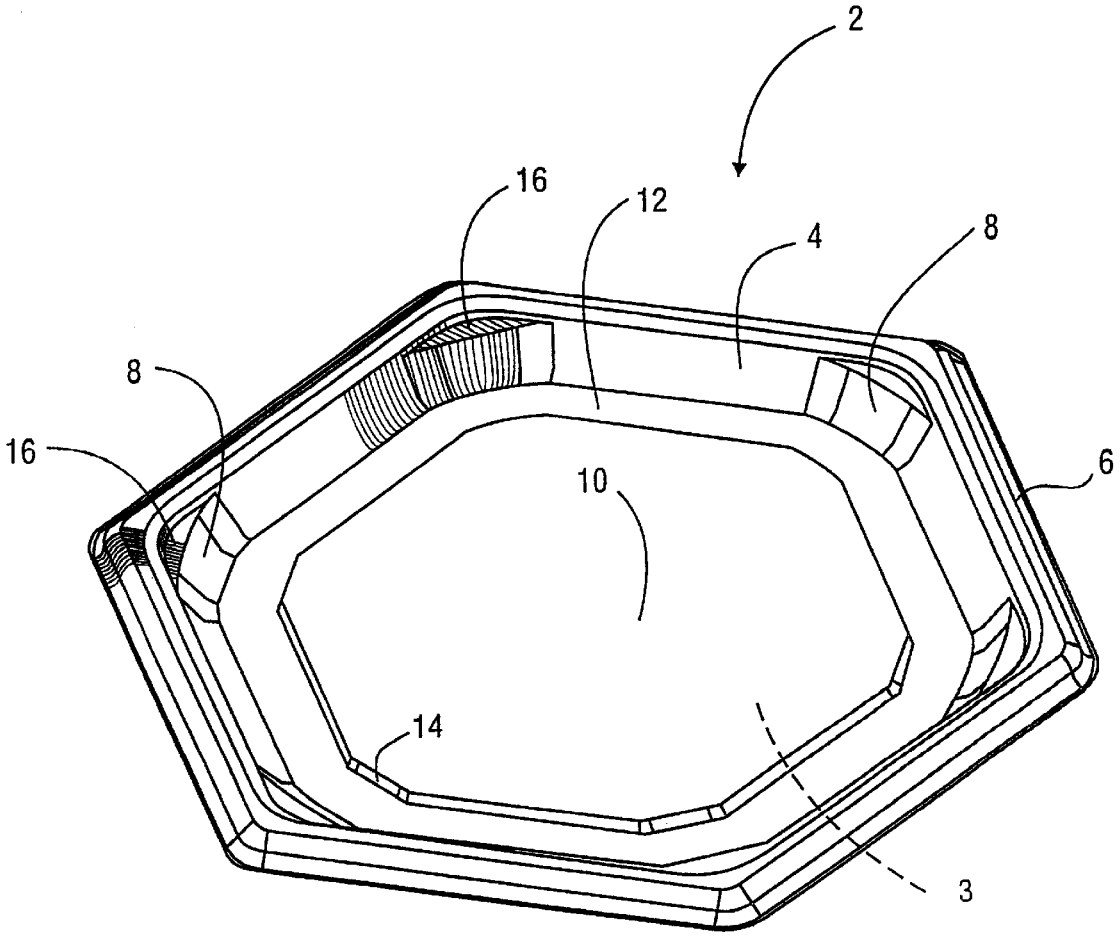
FIG. 1 is an isometric view of the tray.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF THE PREFERRED EMBODIMENT

Referring initially to FIG. 1, a catering tray 2 having a hexagonal periphery is illustrated. The tray 2 has a base 3 and six side walls 4 extending upwardly from the base 3. A flange 6 is attached at an upper portion of the side walls 4 and extends around the periphery of the tray 2. The side walls 4 are strengthened by bar stiffeners 8 which join adjacent side walls 4. These bar stiffeners 8 provide substantial resistance to the torsional and bending stresses the tray 2 undergoes while being handled and transported. Instead of the stresses being concentrated in the corners of adjacent sides 4, the bar stiffeners 8 assist in evenly transferring the stress between adjacent side walls 4 such that the likelihood of failure by deformation or cracking is reduced.

A raised food platform 10 is formed on the base 3 of the tray 2 and allows the food to be aesthetically displayed at the center of the tray 2. The food platform 10 shown in FIG. 1 is substantially hexagonal, but it can also be a variety of shapes such as ovular, circular, or polygonal. A trough 12 is disposed between the food platform 10 and the side walls 4 on the base 3 of the tray 2. The trough 12 provides a region to which the fluids of the food can flow thereby preventing foods from sitting in fluid. The normal motions due to handling and transport shift the fluids from the foods and into the trough 12 where they are captured. Thus, the food platform 10 can be substantially horizontal or slightly angled in the downward direction toward the trough 12 such that fluids flow to the trough 12 under the force of gravity. Alternatively, the food platform 10 could have small channels situated below the surface of the food platform 10 which slope to the trough 12 such that the fluid flow path would not be hindered by the food congregated on the food platform 10.

The food platform 10 also serves the purpose of providing rigidity when the tray 2 is loaded with food and being handled. The food platform 10 acts as a structural rib on the base 3 of the tray 2 and resists the tendency of the base 3 to bow downwardly when holding food. Additionally, the food platform 10 has angled corners 14 which transfer stresses between adjacent edges of the food platform 10. The angled corners 14 reduce the stress concentration on the edges of the food platform 10, and thus, reduce the likelihood of failure.

The tray 2 also includes recessed platforms 16 at the region where adjacent side walls 4 meet. The recessed platforms 16 provide a surface against which a portion of a cover which shields the food on the tray 2 abuts. The forces on such a cover are easily transmitted into the tray 2 via the recessed platforms 16. This reduces the force transferred through the interlocking mechanism between the cover and the tray which minimizes the risk that the cover will detach from the tray 2. The recessed platforms 16 are positioned below and are encompassed within the upper portion of the side walls 4 such that an abutting structure from the cover is retained on the recessed platform 16 and prohibited for moving therefrom. The recessed platforms 16 are shown in FIG. 1 as having a generally triangular shape. However, the shape of the recessed platforms 16 could be ovular, circular or polygonal. Furthermore, the recessed platforms 16 could themselves have recesses endowing them with a three dimensional formation wherein an abutting structure from a cover would have a substantially similar formation for interlocking.

The recessed platforms 16 also assist in the structural integrity of the tray 2. The recessed platforms 16 transfer the forces around the corners of the flange 6 and the upper portions of the side walls 4. This is one reason the recessed platforms 16 have been placed at the corners of the tray 2 in FIG. 1. Alternatively, the recessed platforms 16 could be moved from the comers to an intermediate portion of the side walls 4. And, the recessed platforms 16 could also be placed lower on the side walls 4 as well to more directly transfer the force to the base 3 of the tray 2.

Figure 2:
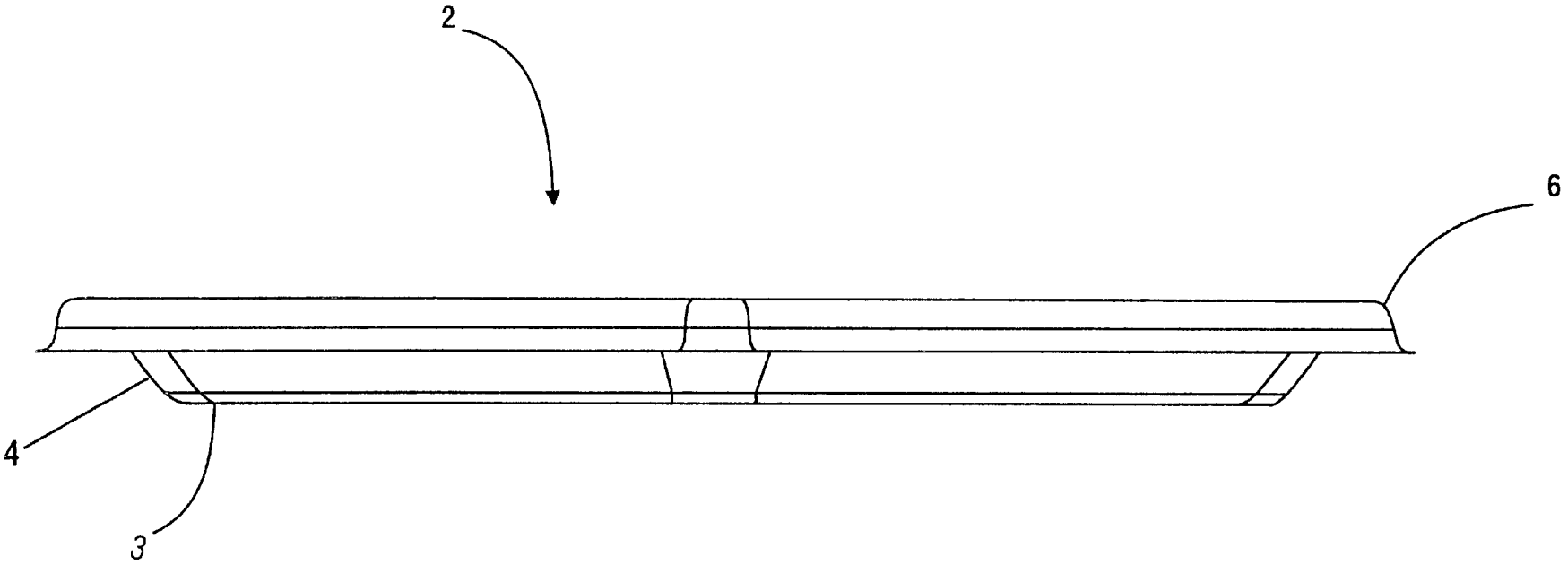
FIG. 2 is a side view of the tray.

FIG. 2 illustrates a side view of the tray 2. This view more accurately shows the shape of the flange 6 and the general height of the tray 2. Additionally, the shape of the side walls 4 can be more easily discerned. The height of the flange 6 as measured from the base 3 which is contacting a surface below the tray 2 is fixed for all sizes of trays 2. For example, tray 2 in FIG. 2 has the same flange height as a tray which is twice as wide or half as wide. This feature facilitates the presentation of an arrangement of catering trays 2 since no flange of one tray can protrude over the top of another tray. Although this feature may be beneficial in some applications, the flanges 6 of different trays 2 can have different heights.

Figure 3:
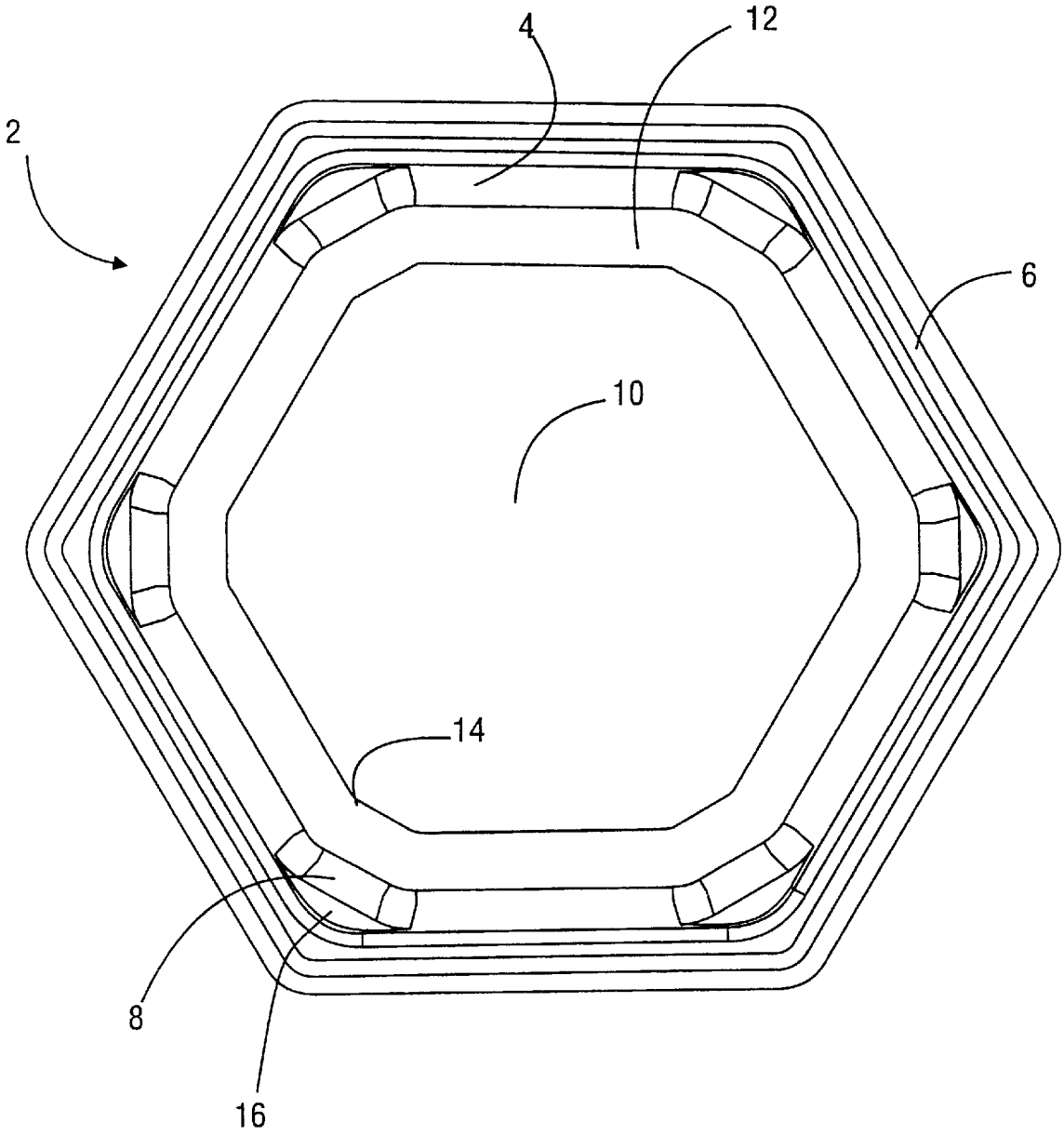
FIG. 3 is a top view of the tray.

FIG. 3 is a top view of the tray 2 wherein the hexagonal periphery is more readily visualized.

Figure 4:
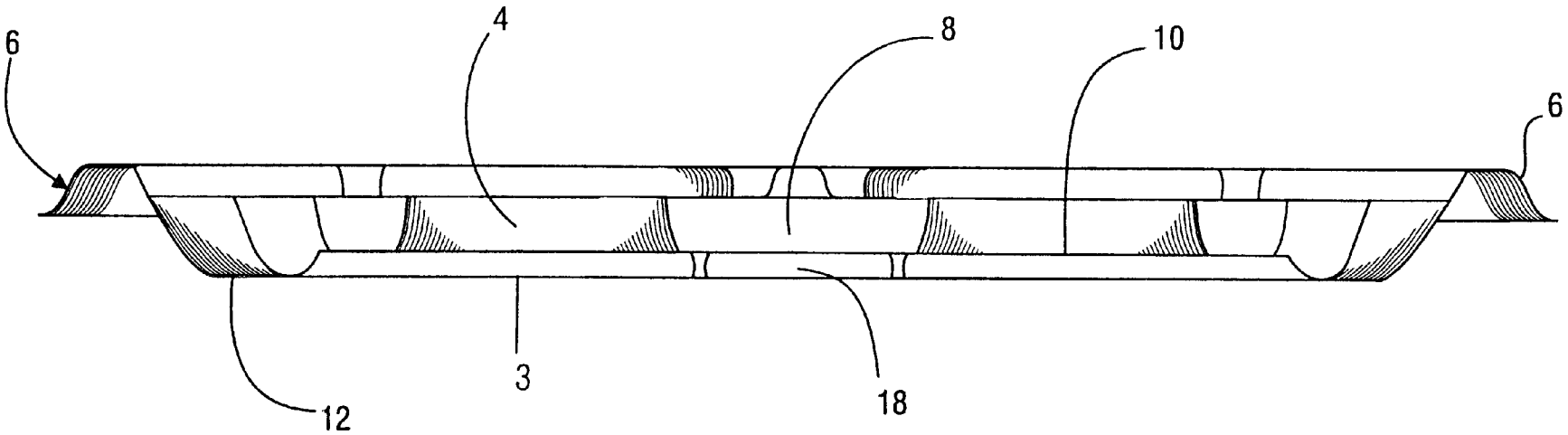
FIG. 4 is a cross-sectional view of the tray.

FIG. 4 is a cross-sectional view of the tray 2. The relative height of the food platform 10 can be easily seen. Also, the raised platform 10 results in a stacking recess 18 which allows the tray 2 to receive a stacking projection from a cover attached to another tray which would be directly below the tray 2. Thus, a series of trays can be easily stacked and transported without having the top tray slip from the stack.

Also in FIG. 4, the profile of the flange 6 is shown in detail. The flange 6 has a profile which allows it to interlock with an interlocking closure of a cover. Thus, the profile of the flange 6 is chosen according to the interlocking closure available on the cover. Also, the flange 6 has an underside area which allows for easy gripping of the tray 2. The underside could have a gripping profile wherein fingers are positioned on the profile to ensure that they do not slip from the flange.

Generally, the tray 2 is made of polymeric material. One example would be polystyrene with a thickness in the range from approximately 0.010 inch to approximately 0.050 inch. Generally, the larger the tray 2, the thicker the material must be. This tray 2 could be thermoformed from polystyrene sheets. If the tray 2 is being designed for extra loading, then thicker sheets of polystyrene could be used. Additionally, polyethylene or polypropylene are a few of many other polymers which can be used as well. And, numerous other suitable methods of manufacturing such as blow molding, injection molding, and compression molding could be performed as well.

In addition to polymers, stronger materials such as reinforced polymers or metals can be used. This may be appropriate if heavier foods, such as large roasts, are the desired catered food or if the tray 2 is to be very large. Metal trays may be advantageous since metal resists higher temperatures and can be reused numerous times without succumbing to fatigue loading. Aluminum may be an appropriate choice since it is inexpensive and easy to process. The typical sizes of the catering trays 2 are 12, 16, and 18 inches.

Figure 5:
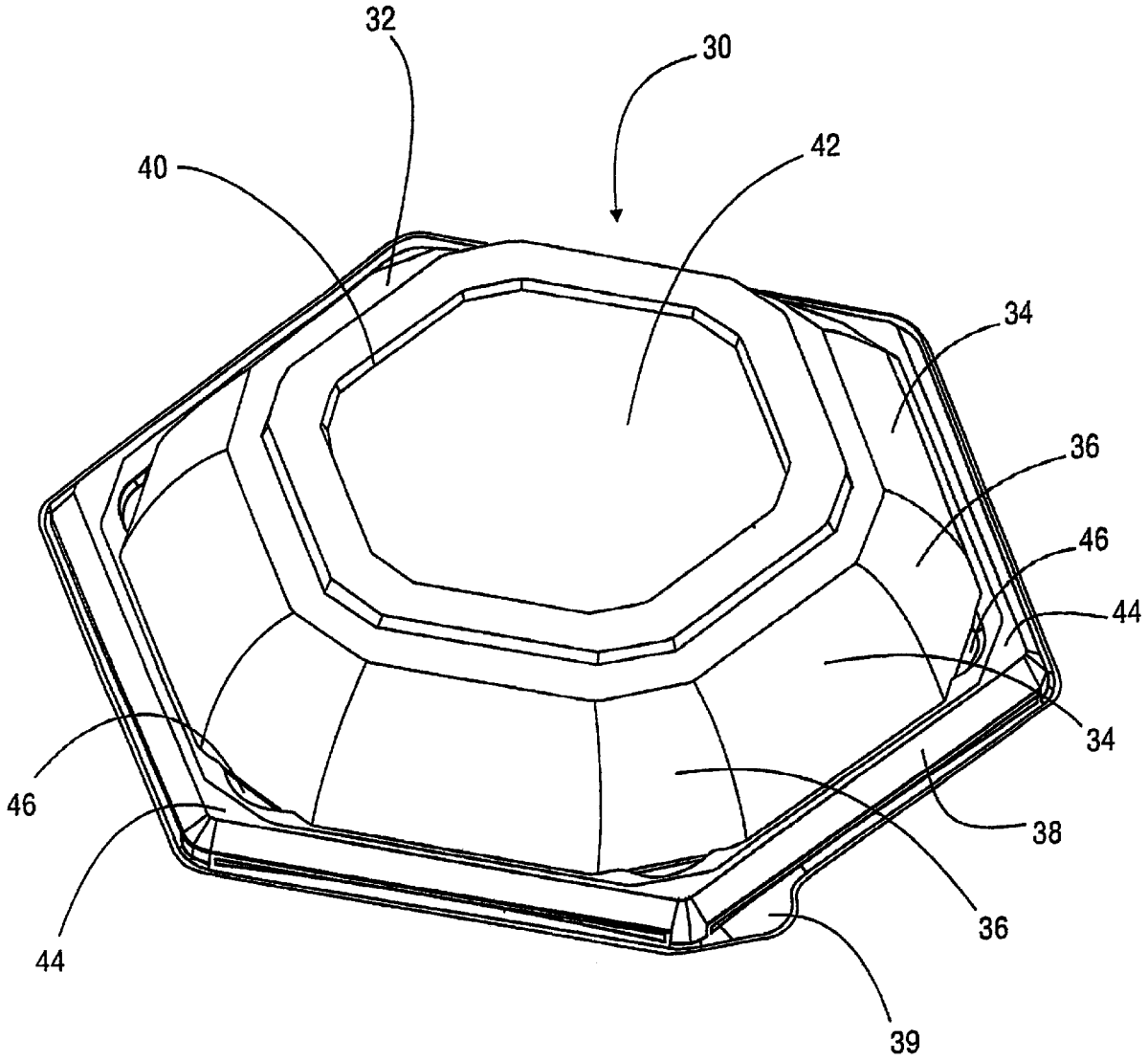
FIG. 5 is an isometric view of the domed cover.

FIG. 5 illustrates a domed cover 30 for covering a catering container, such as the catering tray 2 shown in FIGS. 1–4. The domed cover 30 has a top 32 and cover walls 34 extending downwardly from the top 32. A cover stiffening bar 36 is attached to the top 32 and joins adjacent cover walls 34. A turned-down flange 38 extends around the periphery of the domed cover 30 and is attached to a lower portion of the cover walls 34. The turned-down flange 38 receives a portion of a container that releasably engages the domed-cover 30 such as the flange 6 on the tray 2 in FIGS. 1–4. Thus, the domed cover 30 can be detachably attached to a catering container. A tab 39 is connected to the turned-down flange 38 along the periphery of the tray 2 to assist in the removal of the domed cover 30 from the catering container to which it is attached. The details of the turn-down flange 38 are described more in detail below and shown in detail in FIG. 8A.

A stacking projection 40 is positioned at the top 32 of the domed cover 30. The stacking projection 40 allows a catering container stacked above the domed cover 30 to fit onto the domed cover 30 to prevent such a catering container from sliding. The stacking recess 18 shown in FIG. 4 of the catering tray 2 is an example of a catering container portion which mates well with the stacking projection 40. The stacking projection can be a continuous surface which spans across the top 32. Alternatively, the stacking projection 40 can have an impression 42, as shown in FIG. 5, at its center which allows for another method in which to mate stacked catering containers. As will be discussed below in reference to FIGS. 9–12, this impression 42 will mate with a corresponding feature in a catering bowl 60.

Because the stacking projection 40 and the impression 42 mate respectively with the tray 2 of FIGS. 1–4 and the bowl 60 of FIGS. 9–12, the domed cover 30 can be used as an elevating device. After the domed cover 30 is removed from the tray 2 or bowl 60, it is placed on the table surface. The tray 2 or bowl 60 is then placed above and mated with the domed cover 30. Thus, the tray 2 or bowl 60 will not move relative to the domed cover 30. This is useful when placing a tray 2 or bowl 60 at the back of a catering table since this feature allows a consumer to reach the food easier. It is also useful from an aesthetic standpoint since it allows one tray 2 or bowl 60 to be accented or serve as a centerpiece in an arrangement of numerous trays or bowls.

The domed cover 30 has a number of structural components which provide rigidity. The cover stiffening bars 36 positioned between the cover walls 34 reduce stress concentration which would have been present had the cover walls 34 just merely met each other. The cover stiffening bars 36 help to resist the torsional and bending stresses of the cover 30. Thus, the need for multiple stiffening ribs, which have been used in the past, no longer exists. Therefore, the domed cover 30 has substantial viewing clarity due to the lack of ribs which enhances the presentability of the food within the catering container. Furthermore, because the convectional heat transfer from a surface is proportional to the area of the surface, the domed cover 30 lacking multiple ribs has less surface area, and therefore, less heat transfer. Thus, hot food encased under the domed cover 30 remains hotter while cold food remains colder in comparison to a cover utilizing multiple ribs acting as heat transfer fins.

The turned-down flange 38 which circumscribes the periphery of the domed cover 30 also has flange connectors 44 which resist torsional and bending stresses on the domed cover. The flange connectors 44 lie between adjacent portions of the turned-down flange 38 which meet at angles along the periphery of the domed cover 30.

The cover walls 34 are arced outwardly to enhance the structural integrity of the domed cover 30. The curvature allows for the vertical forces exerted on the top 32 of the domed cover 30 to be transferred to the bottom portion of the domed cover 30 near the turned-down flange 38. Additionally, the curvature of the cover walls 34 resists any force loads laterally exerted into the cover walls 34. Thus, compared to a planar wall, the arced cover walls 34 are less likely to buckle inwardly under lateral force loads. Also, the cover stiffening bars 36 are arced to provide structural qualities similar to those of the cover walls 34.

The domed cover 30 also includes indentations 46 which are used to transfer forces between the domed cover 30 and the catering container to which it attaches. Each of the indentations 46 abut against a corresponding platform on the catering container. For example, the recessed platforms 16 of the catering tray 2 in FIGS. 1–4 provide a surface against which the indentations 46 may abut. Therefore, when the interlocking features between the domed cover 30 and its corresponding catering container are subjected to vertical or lateral forces, the likelihood that the interlocking feature will remain intact is increased.

Figure 6:
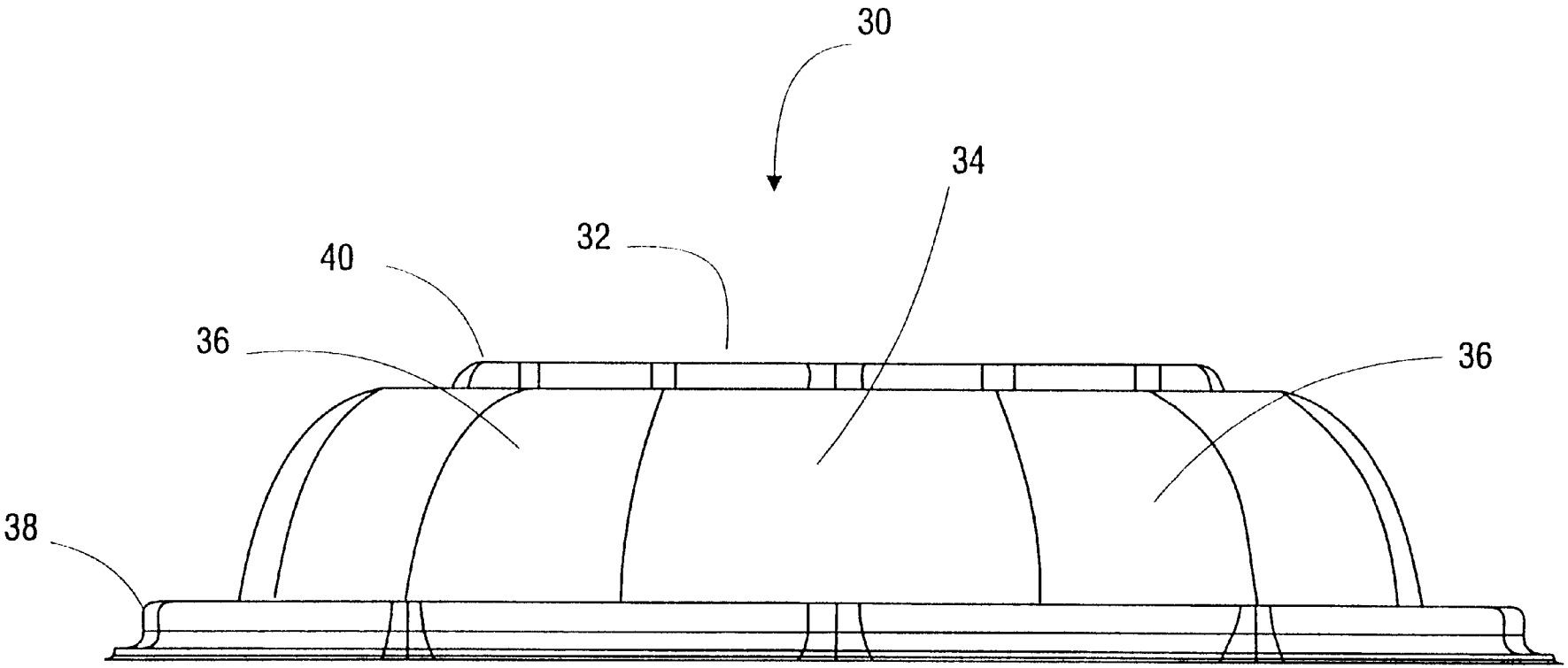
FIG. 6 is a side view of the domed cover.

FIG. 6 is a side view of the domed cover 30. The relative height of the stacking projection 40 is illustrated as is the height of the turned-down flange 38. More importantly, the arc shaped cover walls 34 and cover bar stiffeners 38 is also shown.

Figure 7:
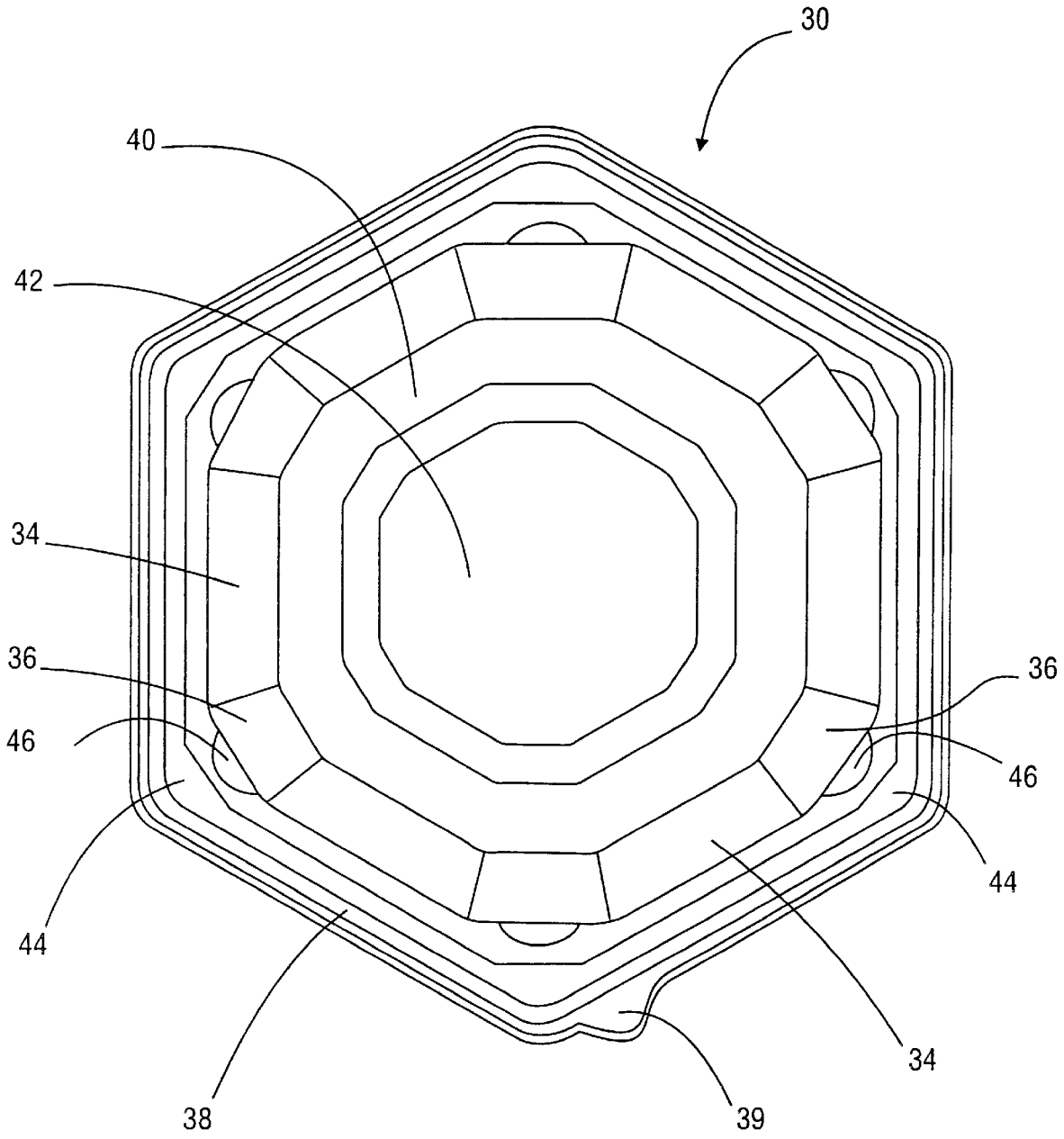
FIG. 7 is a top view of the domed cover.

FIG. 7. is a top view of the domed cover 30. The hexagonal periphery can be readily seen. Also, the dimensions of the stacking projection 40 and the stacking impression 42 can be compared. Additionally, the profile of the indentations 46 can be observed. Lastly, the orientations of the flange connectors 44 with respect to the turned-down flange 38 and the cover bar stiffeners 36 with respect to the cover walls 34 are easily discerned.

Figure 8A:
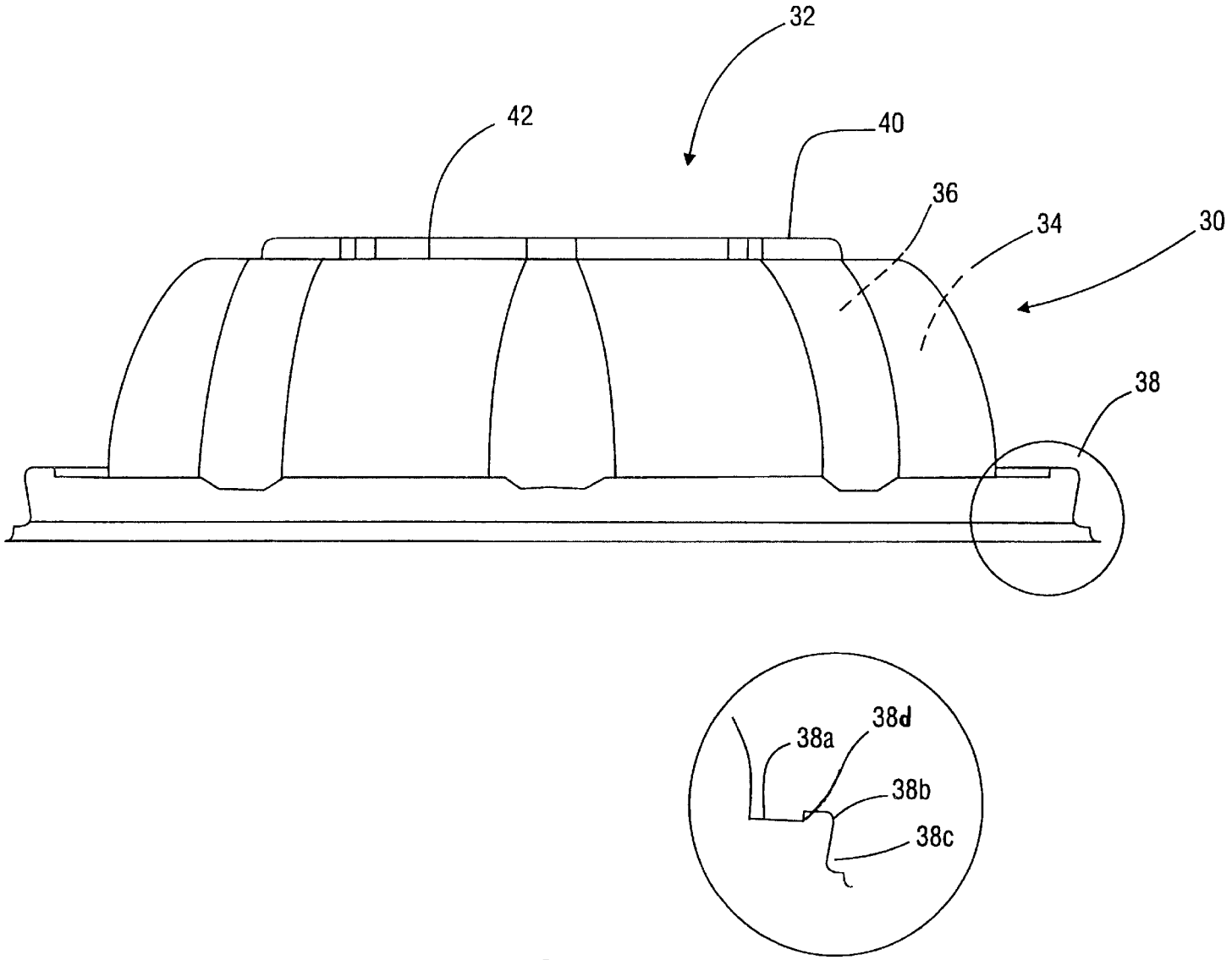
FIG. 8A is a cross-sectional view of the domed cover.

FIG. 8A is a cross-sectional view of the domed cover 30. The details of the turned-down flange 38 can be understood. Because the turned-down flange 38 provides the interlocking closure onto the catering container, it must guide and latch the domed cover 30 onto the catering container. First, a horizontal flange portion 38*a* extends from the cover walls 36. A guide-in portion 38*b* accurately positions the domed cover 30 over the catering container. An undercut portion 38*c* bends inwardly and receives a corresponding interlocking structure on the catering container. The undercut portion 38*c* then returns to its normal position wherein the corresponding interlocking structure of the catering container is latched thereunder. The vertical portion 38*d* between the horizontal flange portion 38*a* and the guide-in portion 38*b* also serves to limit the deformation and cracking that may occur along the turned-down flange 38 when it is subjected to forces. Also, the interlocking between the domed cover 30 and the catering container allows the assembly to be picked up by grasping only the domed cover 30. When picked up at two opposing sides, the six corners of the domed cover 30 catch the corresponding corners of the mating catering container thereby supporting the catering container. The flange 6 of catering tray 2 in FIGS. 1–4 is an example of an interlocking structure which mates with the down-turned flange 38.

Figure 8B:
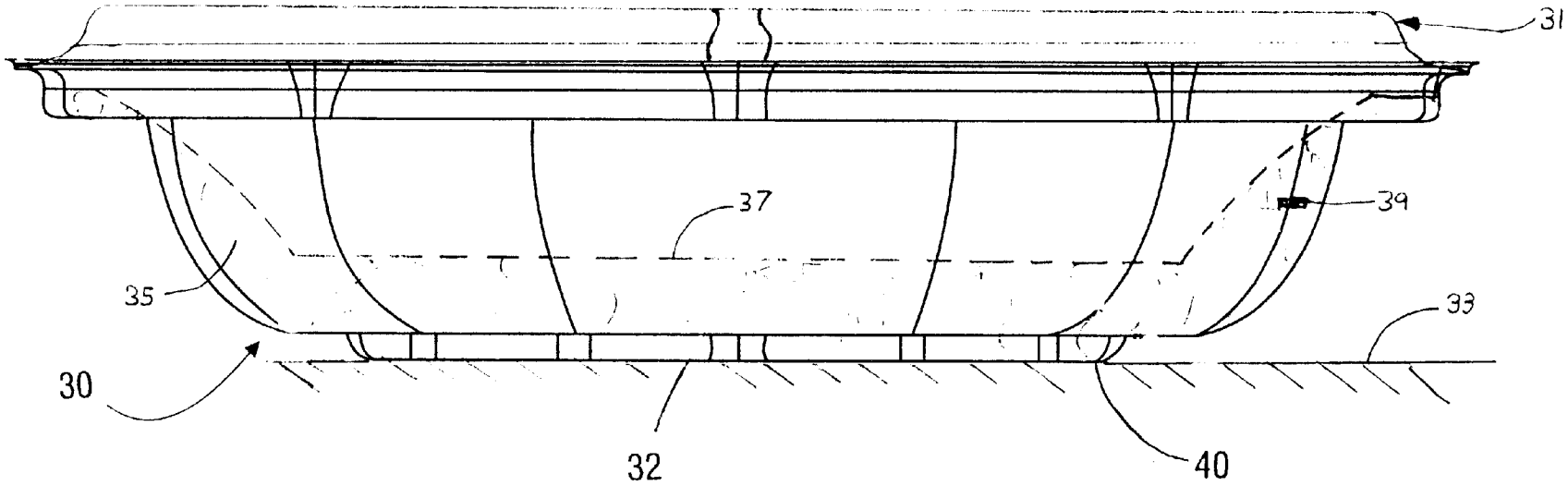
FIG. 8B is a cross-sectional view of the domed cover holding a catering container.

As shown by FIG. 8B, the domed cover 30 also serves an additional function when removed from a catering container 31. The domed cover 30 can be turned over and positioned such that its top 32 is resting on a table surface 33. The catering container 31 is then placed within the domed cover 30 and snapped into the internal region of the flange 38. This is quite useful in that those catering containers positioned at the back of a table can be elevated such that a consumer can reach them easier. This feature also allows the catering container 31 to be emphasized by elevating it over other horizontally adjacent containers.

Additionally, the domed cover 30 can be filled with a solid or liquid 35 which acts as a thermal reservoir having a substantial thermal capacity. When the container 31 is placed into the domed cover 30, a base 37 of the container 31 preferably contacts the solid or liquid 35 of the thermal reservoir to help maintain the food at a desired temperature. Energy transfer occurs primarily through conduction, although convection may occur if an air gap lies between the base 37 of the catering container 31 and the solid or liquid 35 contained within the domed cover 30. For example, if the container 31 holds a cold food, like shrimp cocktail, then cold water, ice water, chunks of ice, or small shaved ice particles could be placed in the domed cover 30 to maintain the shrimp at a low temperature. On the other hand, if a hot food, like ravioli, is placed in the container 31, then hot water could be placed in the domed cover 30 to maintain the ravioli at a high temperature. Obviously, the type of material chosen for the domed cover 30 and the container 31 limits the temperature of the thermal reservoir. The domed cover 30 may also have a fill line 39 to indicate the maximum volume of liquid or solid 35 that should be placed in the domed cover 30 prior to inserting a particular container 31. Thus, when placing the container 31 into the domed cover 30 after filling it to the level prescribed by the fill line 39, the catering container 31 still precisely fits into the domed cover 30 without an overflow of liquid or solid 35 being forced from the domed cover 30.

The domed cover 30 is generally made of a transparent polymeric material although an opaque material may be useful in some applications. One example would be oriented polystyrene with a thickness in the range from approximately 0.010 inch to approximately 0.025 inch. The domed cover 30 could be thermoformed from polystyrene sheets. If the domed cover 30 is being designed for extra loading, then thicker sheets of oriented polystyrene could be used. Additionally, acrylics and polycarbonates are a few of many other transparent polymers which can be used as well. And, numerous other suitable methods of manufacturing such as blow molding, injection molding, and compression molding could be performed as well.

Figure 9:
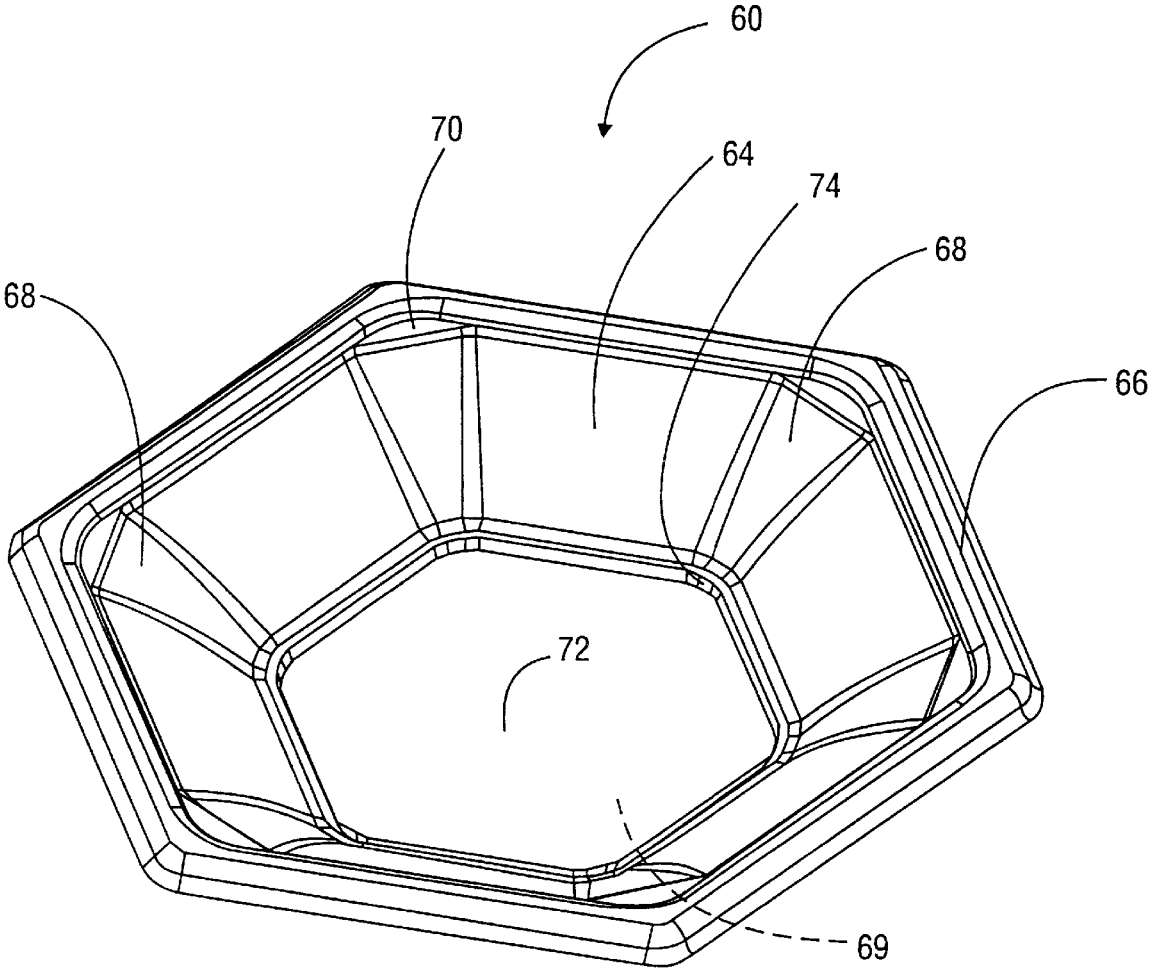
FIG. 9 is an isometric view of the bowl.

FIG. 9 is a perspective view of a catering bowl 60. The catering bowl 60 is similar to the catering tray 2 except six bowl walls 64 extend upwardly further from a bowl base 69 than the side walls 4 do from the base 3 in tray 2 as depicted FIGS. 1–4. This creates a larger volume in the bowl 60 for receiving food. A flange 66 is attached at an upper portion of the bowl walls 64 and extends around the periphery of the bowl 60. Adjacent bowl walls 64 are joined by bowl stiffeners 68 which provide substantial resistance to the torsional and bending stresses the bowl 60 undergoes while being handled and transported. Instead of the stresses being concentrated in the corners of adjacent bowl walls 64, the bowl stiffeners 68 assist in evenly transferring the stress between adjacent bowl walls 64 such that the likelihood of failure by deformation or cracking is reduced.

The bowl 60, like the tray 2, also includes recessed platforms 70 at the region where adjacent bowl walls 64 meet. The recessed platforms 70 provide a surface against which a portion of a cover which shields the food on the bowl 60 abuts. The forces on such a cover are transmitted into the bowl 60 via the recessed platforms 70 to reduce the force transferred through the interlocking mechanism between the cover and the bowl 60. Thus, it is less likely that the cover will detach from the bowl 60. The recessed platforms 70 are positioned below and are encompassed within the upper portion of the bowl walls 64 such that an abutting structure from the cover is retained on the recessed platform 70 and prohibited for moving therefrom. The recessed platforms 70 are shown in FIG. 9 as having a generally triangular shape. However, the shape of the recessed platforms 70 could be ovular, circular or polygonal. Furthermore, the recessed platforms 70 could themselves have recesses endowing them with a three dimensional profile wherein an abutting structure from a cover would have a substantially similar profile to which for interlocking.

The recessed platforms 70 also assist in the structural integrity of the bowl 60. The recessed platforms 70 transfer the forces around the corners of the flange 66 and the upper portions of the bowl walls 64. This is one reason the recessed platforms 70 have been placed at the corners of the bowl 60 in FIG. 9. Alternatively, the recessed platforms 70 could be moved from the corners to an intermediate portion of the bowl walls 64. And, the recessed platforms 70 could also be placed lower on the bowl walls 64 as well to more directly transfer the force to the base 69 of the bowl 60.

The bowl walls 64 are inwardly curved to resist the force produced by the food contained within the bowl 60 which push outwardly from the interior of the bowl walls 64 in the bowl 60. Thus, the bowl 60 can hold additional weight without having the bowl walls 64 distort under the weight of the food.

The bowl 60 also includes a stacking protrusion 72 at the base 69 of the bowl 60. Smooth base corners 74 of the stacking protrusion 72 near the base 69 transfer stress from along the sides of the base 69 thereby minimizing stress concentrations which occur at sharp corners. The stacking protrusion 72 interlocks with a mating recess on a cover of an adjacent catering container assembly disposed below the bowl 60. As an example, the impression 42 on cover 30 in FIG. 5 interlocks with the stacking protrusion 72. Thus, stacks of catering bowls 64 can be easily made while reducing the risk of instability or sliding.

Figure 10:
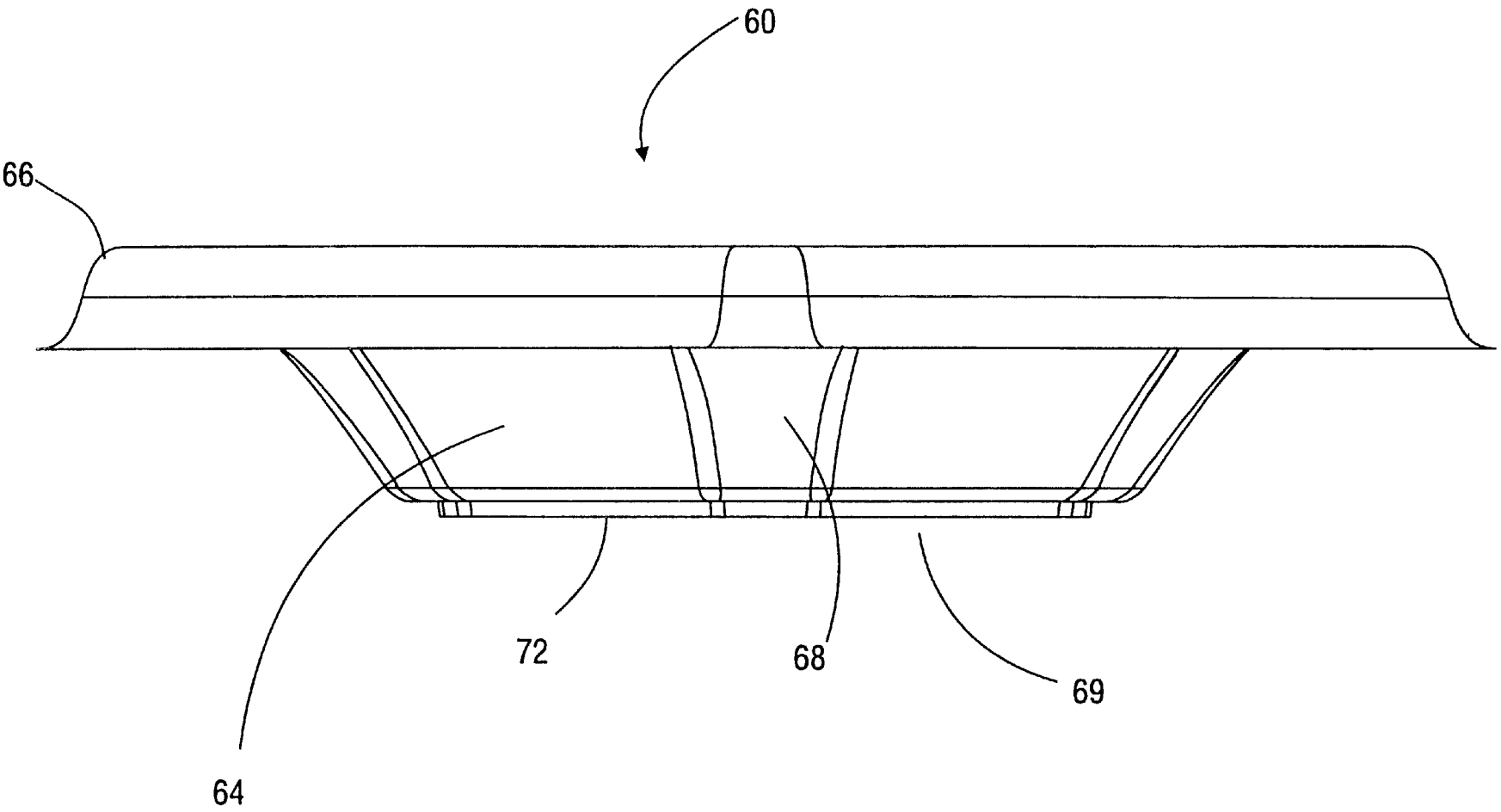
FIG. 10 is a side view of the bowl.
Figure 11:
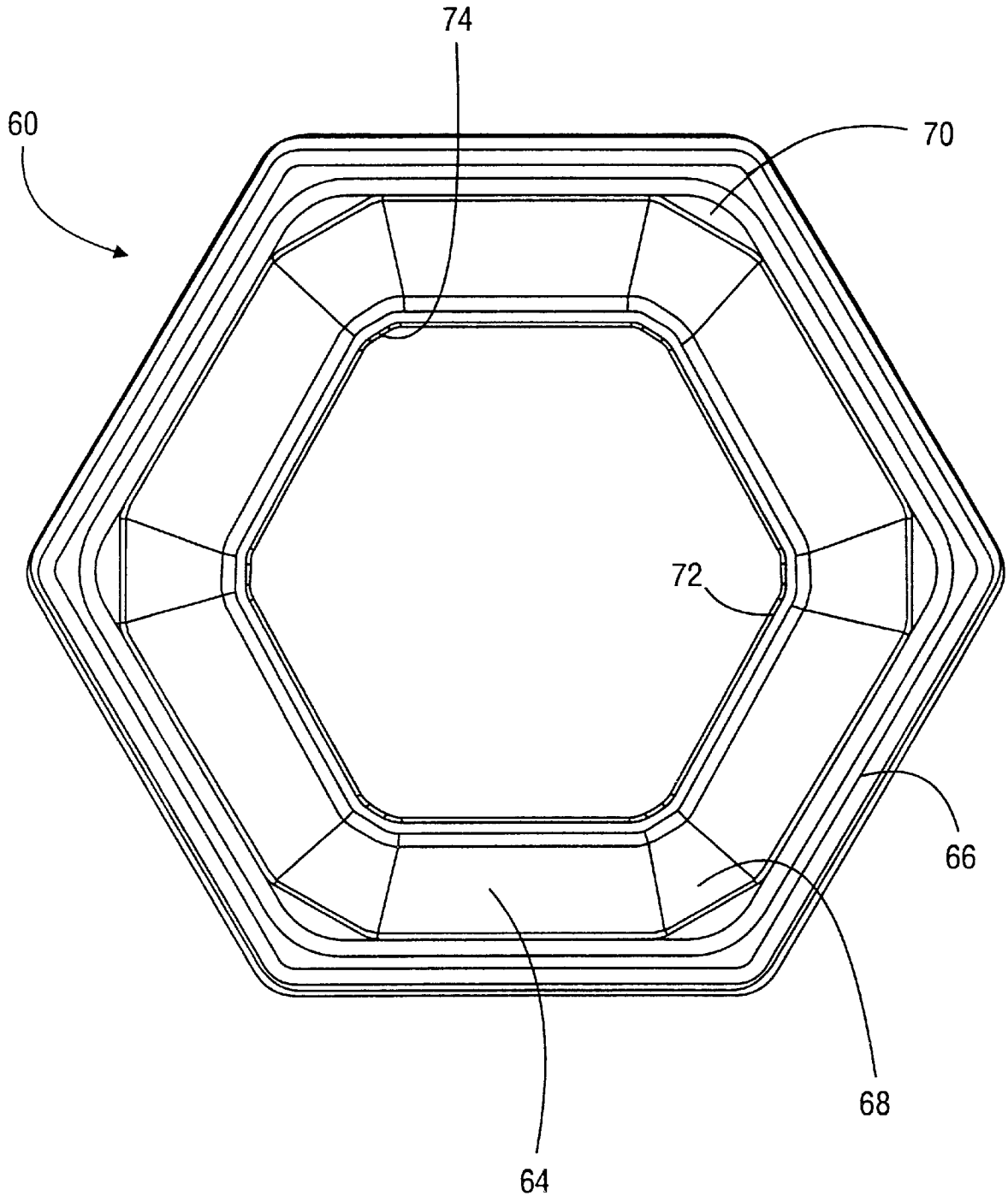
FIG. 11 is a top view of the bowl.
Figure 12:
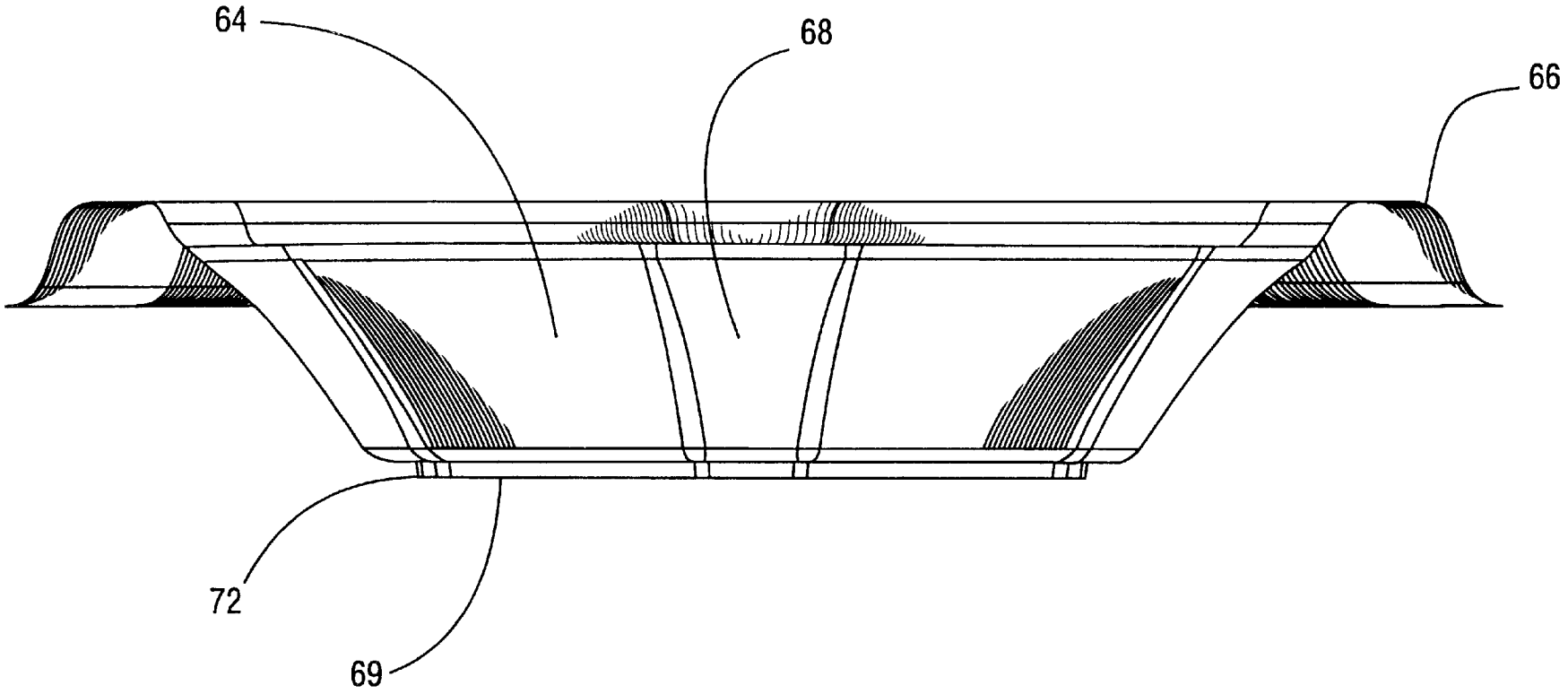
FIG. 12 is a cross-sectional view of the bowl.

FIGS. 10, 11, and 12 show the side view, top view, and cross-sectional view of the catering bowl 60 respectively. The relative height of the side walls can be seen as well as the angles at which the bowl walls 64 depart from the base 69. Additionally, the height of the stacking protrusion 72 can be visualized.

The catering bowl 60 of FIGS. 9–12 can be formed of the same materials having the same thicknesses as the catering tray 2 of FIGS. 1–4. And, the method of manufacturing the bowl 60 is similar to the manufacturing methods of the tray 2 as well. Additionally, the bowls 60 generally come in sizes of 12, 16 and 18 inches.

Figure 13:
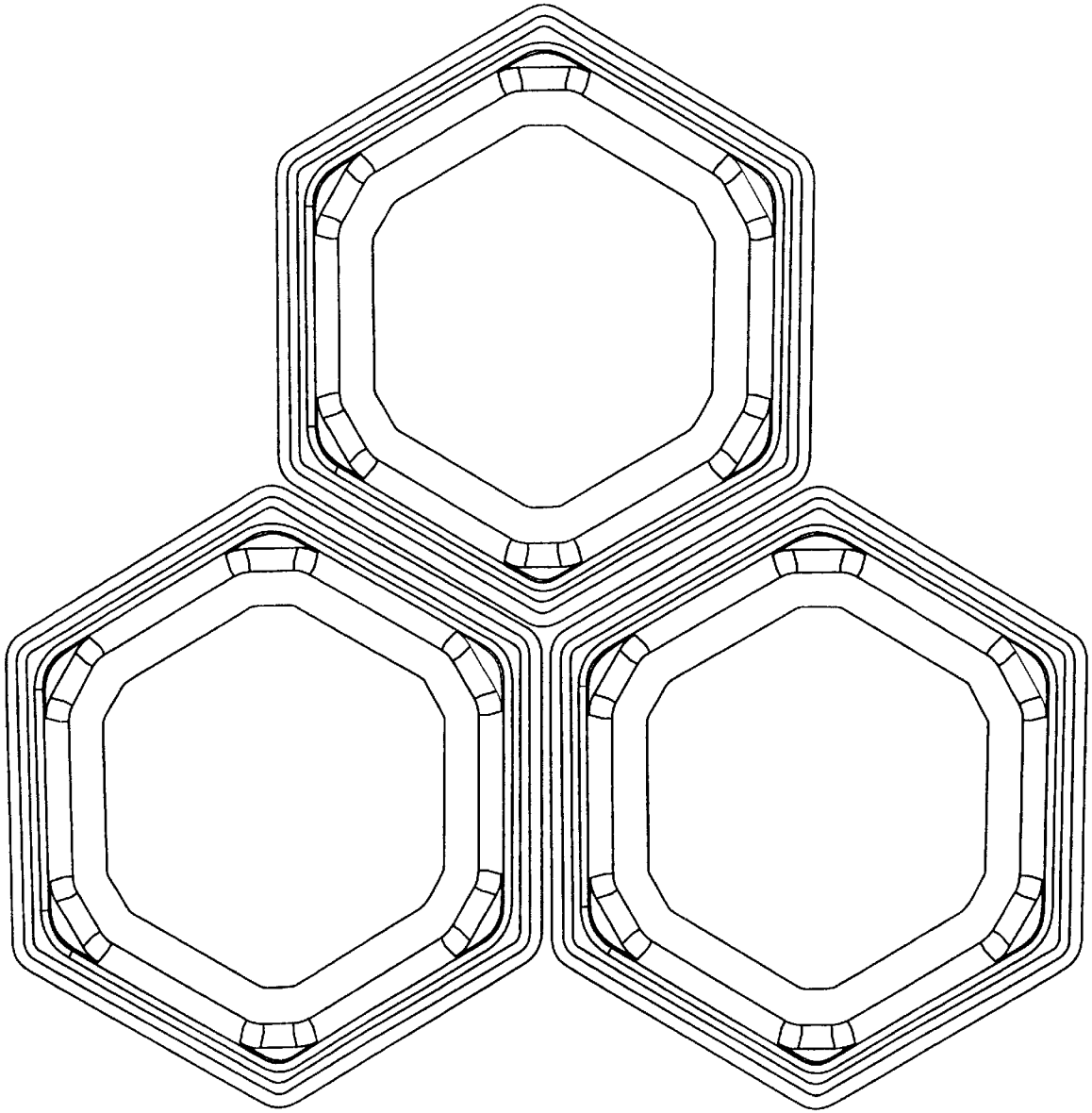
FIG. 13 is a top view of three tray or bowl catering assemblies which are adjacent each other.

FIG. 13 illustrates three catering trays and/or catering bowls which are adjacent each other. The catering trays are modular in that each is interchangeable and can be placed at another location. The amount of surface area on a table needed to arrange the bowls or trays is minimized since the hexagonal shape allows the trays or bowls to fit compactly against each other.

Figure 14:
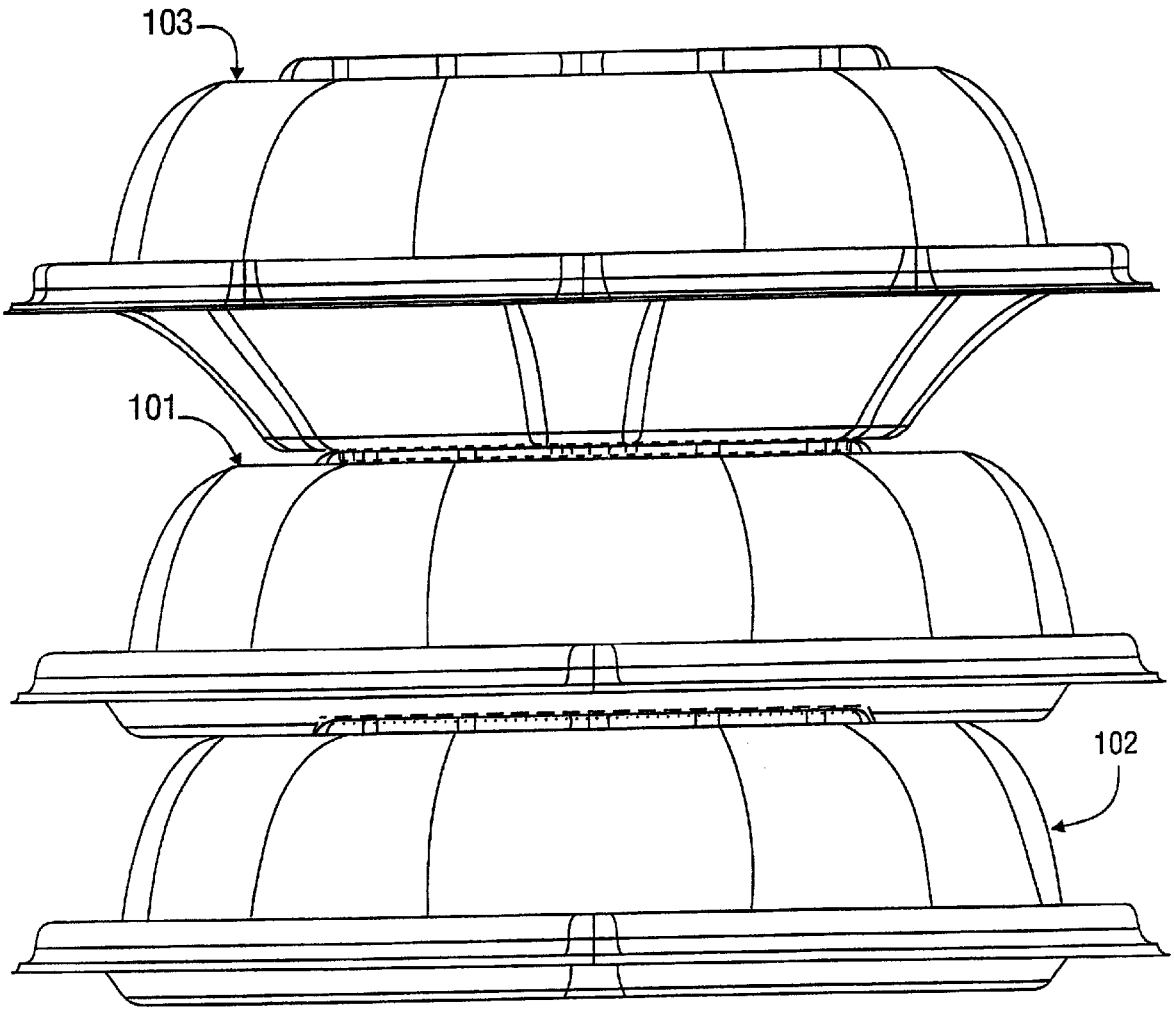
FIG. 14 is a side view of two tray-bowl catering assemblies which are vertically stacked on each other.

FIG. 14 is a cross-sectional view of two catering tray and domed cover assemblies 101, 102 and a catering bowl and domed cover assembly 103 which are vertically stacked on each other. The stacking recess on the base of the tray in the first assembly 101 mates with the stacking projection on the top of the domed cover in the second assembly 102. And, the stacking projection of the bowl assembly 103 fits into the impression on the tray assembly 101. As can be seen, a group of assemblies can be stacked together to provide for easy handling, storage, and transportation.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A catering container assembly for storing, transporting, and presenting food, comprising:

a tray having a base and substantially continuous side walls extending upwardly from said base to define a height of said tray, said tray having a plurality of discrete recessed platforms disposed adjacent to said substantially continuous side walls at an intermediate position along said height such that portions of said substantially continuous side walls are positioned above said plurality of discrete recessed platforms, each of said plurality of discrete recessed platforms being bounded thereabove by at least two relatively non-aligned surfaces; and a domed cover having a top and cover walls extending downwardly from said top, said domed cover having a plurality of indentations adjacent said cover walls, each of said indentations abutting a respective one of said plurality of discrete recessed platforms for transferring a force from said domed cover into said tray, said domed cover being detachably connected to said tray.

2. The catering container assembly of claim 1, wherein each of said plurality of discrete recessed platforms are disposed on an interior of said side walls.

3. The catering container assembly of claim 1, wherein said tray has a flange extending around said side walls, said flange having vertically extending portions connected to said side walls, and wherein each of said plurality of discrete recessed platforms are disposed inward of said vertically extending portions of said flange.

4. The catering container assembly of claim 1, wherein each of said plurality of discrete recessed platforms is generally parallel to said base.

5. The catering container assembly of claim 1, wherein each of said side walls connects to an adjacent one of said side walls at a joint, and one of said plurality of recessed platforms being disposed at each of said joints, said at least two relatively non-aligned surfaces being adjacent side walls meeting at said joint.

6. The catering container assembly of claim 1, wherein each of said plurality of discrete recessed platforms has a recessed platform surface and each of said plurality of indentations has an indentation surface, each of said indentation surfaces abutting a respective one of said plurality of discrete recessed platforms at said recessed platform surface.

7. The catering container assembly of claim 6, wherein each of said platform surfaces and said corresponding indentation surface have a substantially similar profile.

8. The catering container assembly of claim 1, wherein said tray has a flange extending around and connected to said side walls, and wherein said domed cover includes a flange receiving portion for receiving said flange and thereby providing for detachable connection of said domed cover to said tray.

9. The catering container assembly of claim 8, wherein said flange receiving portion maintains said detachable connection with said flange in response to a user hoisting said domed cover.

10. The catering container assembly of claim 1, wherein said domed cover includes a plurality of cover stiffening bars, each of said plurality of cover stiffening bars being disposed between and joining adjacent ones of said cover walls.

11. The catering container assembly of claim 10, wherein each of said plurality of cover stiffening bars is attached to and projects downwardly from said top.

12. The catering container assembly of claim 1, wherein said tray includes a plurality of bar stiffeners, each of said plurality of bar stiffeners being disposed between and joining adjacent ones of said side walls.

13. The catering container assembly of claim 12, wherein each of said plurality of bar stiffeners is attached to and projects upwardly from said base, each of said plurality of discrete recessed platforms being connected to an upper portion of a corresponding one of said plurality of bar stiffeners.

14. The catering container assembly of claim 1, wherein said cover walls are outwardly arced.

15. The catering container assembly of claim 1, wherein said base includes a stacking recess on an underside of said tray and said domed cover has a stacking projection extending upwardly from said top, and wherein said stacking recess is releasably engageable with said stacking projection.

16. The catering container assembly of claim 1, further including a food platform projecting upwardly from said base for presenting said food, said food platform and said side walls defining a trough therebetween.

17. The catering container assembly of claim 1, wherein said side walls of said tray extend upwardly a substantial length from said base thereby forming a bowl shaped tray for receiving food.

18. The catering container assembly of claim 17, wherein said at least two non-aligned surfaces are at an obtuse angle with respect to said corresponding one of said plurality of recessed platforms.

19. The catering container assembly of claim 1, wherein said tray and said domed cover have substantially hexagonal peripheries thereby defining a substantially hexagonal shape for said catering container assembly.

20. A catering tray for storing, transporting, and presenting food products, comprising:

a base;

a plurality of side walls extending upwardly from said base to define a height of said tray, each of said plurality of side walls having an upper portion, adjacent ones of said side walls meeting at a corner joint;

a plurality of recessed platforms connected to at least one of said side walls at an intermediate position along said height of said tray below said upper portion, each of said plurality of recessed platforms being located at one of said corner joints and for receiving a corresponding structure from a cover to be attached to said tray, each of said plurality of recessed platforms being a surface defined by a first and second line, said first line following a contour of said corner joint, said second line being non-parallel with said first line, a portion of said side walls extending above said plurality of recessed platforms; and a flange connected to an upper portion of each of said side walls, said flange extending along and defining a substantially hexagonal periphery of said catering tray.

21. A catering tray of claim 20, further including a plurality of bar stiffeners, each of said plurality of bar stiffeners being disposed between and joining adjacent ones of said side walls.

22. A catering tray of claim 21, wherein each of said plurality of bar stiffeners is connected to and projects upwardly from said base.

23. A catering tray of claim 20, further including a food platform projecting upwardly from said base for presenting food, said food platform and said side walls defining a trough therebetween.

24. The catering tray of claim 23, wherein said food platform is angled downwardly to said trough.

25. The catering tray of claim 20, wherein said tray is made of a polymer.

26. The catering tray of claim 25, wherein said polymer is polystyrene.

27. The catering tray of claim 26, wherein the thickness of said polystyrene is in the range from about 0.010 inches to about 0.050 inches.

28. The catering tray of claim 20, wherein said tray is made of a metal.

29. The catering tray of claim 28, wherein said metal is aluminum.

30. The catering tray of claim 20, wherein said plurality of recessed platforms are discrete structures that are spaced from each other by a predetermined distance.

31. The catering tray of claim 20, wherein said plurality of recessed platforms are generally parallel to said base.

32. A domed cover for engaging and covering a catering container, comprising:

a lower portion having a polygonal periphery with projecting corner joints;

a top;

a plurality of cover walls extending downwardly from said top toward said lower portion, each of said plurality of cover walls arcing outwardly and being free of structural ribs;

a plurality of cover stiffening bars, one of said plurality of cover stiffening bars being disposed between and joining adjacent ones of said plurality of cover walls, each of said cover stiffening bars extending across one of said corner joints and being in relative nonalignment with said adjacent ones of said plurality of cover walls, each of said cover stiffening bars having a smaller width than each of said plurality of cover walls, each of said plurality of cover stiffening bars being free of structural ribs, each of said plurality of cover stiffening bars arcing outwardly; and wherein said domed cover is made of a transparent material.

33. The domed cover of claim 32, wherein said top includes means for stacking said container on said domed cover.

34. The domed cover of claim 32, wherein said transparent material is oriented polystyrene.

35. The domed cover of claim 34, wherein the thickness of said oriented polystyrene is in the range from about 0.010 inches to about 0.025 inches.

36. The domed cover of claim 32, further including a tab attached to one of said plurality of cover walls for gripping during removal of said domed cover from said catering container.

37. The domed cover of claim 32, wherein said lower portion includes an outwardly projecting flange connected to said cover walls, said flange defining a substantially hexagonal domed cover periphery.

38. The domed cover of claim 32, further including a plurality of indentations adjacent at least one of said cover walls for engaging said catering container.

39. The domed cover of claim 32, wherein each of said plurality of cover stiffening bars is attached to and projects downwardly from said top toward said lower portion.

40. The domed cover of claim 32, further including a flange extending around and attached to said lower portion, said flange including means for detachably connecting said domed cover to said catering container.

41. A catering bowl for storing and handling food products, comprising:

a base;

a plurality side walls having an upper portion and extending substantially upwardly from said base to define a height, each of said plurality of side walls being arced inwardly;

a flange attached to said upper portion of said side walls and defining a substantially polygonal catering bowl periphery having projecting corner joints, said polygonal periphery being substantially larger than a periphery of said base; and a plurality of bar stiffening elements each of which is disposed between and joins adjacent ones of said plurality of side walls, each of said bar stiffening elements being in relative non-alignment with said adjacent ones of said side walls and extending across one of said projecting corner joints.

42. The catering bowl of claim 41, further including a plurality of recessed platforms connected to at least one of said side walls at an intermediate position along said height for receiving a corresponding structure from a cover to be attached to said bowl.

43. The catering bowl of claim 42, wherein said plurality of recessed platforms are generally parallel to said base.

44. The catering bowl of claim 41, wherein said bowl is made of polymeric material.

45. The catering bowl of claim 44, wherein said polymeric material is polystyrene.

46. The catering bowl of claim 45, wherein said polystyrene in the range from about 0.010 inches to about 0.050 inches.

47. The catering bowl of claim 42, wherein said recessed platforms are discrete structures that are spaced from each other by a predetermined distance.

48. The catering bowl of claim 41, wherein each of said plurality of bar stiffening elements is connected to and projects upwardly from said base, and wherein said catering bowl further includes a plurality of recessed platforms each of which is disposed between adjacent side walls, said recessed platform being connected to upper portions of said bar stiffeners.

49. A catering container assembly for storing, transporting, and presenting food, comprising:

a tray having a base and side walls extending upwardly from said base to define a height of said tray, said tray having a plurality of discrete recessed platforms disposed adjacent said side walls at an intermediate position along said height such that portions of said side walls are positioned above said plurality of discrete recessed platforms, adjacent ones of said side walls being relatively non-aligned and being connected at a joint, one of said plurality of discrete recessed platforms being positioned at each of said joints; and a domed cover having a top and cover walls extending downwardly from said top, said domed cover having a plurality of indentations adjacent said cover walls, each of said indentations abutting a respective one of said plurality of said discrete recessed platforms for transferring a force from said domed cover into said tray, said domed cover being detachably connected to said tray.

50. The catering container assembly of claim 49, wherein said tray has a flange extending around said side walls, said flange having vertically extending portions connected to upper portions of said side walls, and wherein each of said plurality of recessed platforms are disposed inward of said vertically extending portions of said flange.

51. The catering container assembly of claim 49, wherein each of said side walls are substantially continuous.

52. The catering container assembly of claim 49, wherein said side walls of said tray extend upwardly a substantial length from said base thereby forming a bowl shaped tray for receiving food.

53. The catering container assembly of claim 52, wherein said side walls extending from said base are arced inwardly.

54. The catering container assembly of claim 49, wherein said tray has a flange extending around and connected to said side walls, and wherein said domed cover includes a flange receiving portion for receiving said flange thereby providing for a detachable connection of said domed cover to said tray.

55. The catering container assembly of claim 49, wherein said recessed platforms are positioned substantially below upper portions of said side walls.

56. The catering container assembly of claim 49, wherein said tray and said domed cover have substantially hexagonal peripheries thereby defining a substantially hexagonal shape for said catering container assembly.

57. The catering container assembly of claim 49, wherein said plurality of recessed platforms are generally parallel to said base.

58. A catering container assembly for storing, transporting, and presenting food, comprising:

a tray having a base and side walls extending upwardly from said base to define a height of said tray, said tray having a plurality of recessed platforms disposed adjacent said side walls and being generally parallel to said base, said tray having a detachable locking mechanism, said plurality of recessed platforms being independent of said detachable locking mechanism; and a domed cover having a top and cover walls extending downwardly from said top, said domed cover having a plurality of indentations adjacent said cover walls, each of said indentations abutting a respective one of said plurality of said recessed platforms for transferring a force from said domed cover into said tray, said domed cover having a detachable interlocking mechanism for mating with said detachable locking mechanism of said tray.

59. The catering container assembly of claim 58, wherein each of said side walls connects to an adjacent one of said side walls at a corner joint, and one of said plurality of platforms being disposed at each of said corner joints.

60. The catering container assembly of claim 58, wherein said tray and said domed cover have substantially hexagonal peripheries thereby defining a substantially hexagonal shape for said catering container assembly.

61. The catering container assembly of claim 58, wherein each of said side walls are substantially continuous.

62. The catering container assembly of claim 58, wherein said recessed platforms are positioned substantially below upper portions of said side walls.

63. The catering container assembly of claim 58, wherein said side walls of said tray extend upwardly a substantial length from said base thereby forming a bowl-shaped tray for receiving food.

64. The catering container assembly of claim 63, wherein said side walls extending from said base are arced inwardly.

65. The catering container assembly of claim 58, wherein said plurality of recessed platforms are discrete structures that are spaced from each other by a predetermined distance.

66. A catering container made of a polymeric material for storing, transporting, and presenting food products, comprising:

a base having a food platform projecting upwardly therefrom;

a plurality of side walls extending upwardly from said base to define a height of said container, each of said plurality of side walls having an upper portion;

a plurality of discrete recessed platforms connected to at least one of said side walls at an intermediate position along said height of said container below said upper portion of said side walls, each of said plurality of discrete recessed platforms being separated from an adjacent one of said plurality of discrete recessed platforms by a predetermined distance and for receiving a corresponding structure from a cover to be attached to said container, a portion of said side walls extending above said plurality of discrete recessed platforms;

a plurality of bar stiffeners disposed between and joining adjacent ones of said plurality of side walls, one of said plurality of discrete recessed platforms being disposed above a corresponding one of said plurality of bar stiffeners; and a flange connected to said upper portion of each of said side walls, said flange extending along and defining a substantially hexagonal periphery of said catering container, said flange including means for detachably connecting said catering container to a cover, said detachable connecting means being independent of said plurality of discrete recessed platforms.

67. The catering container of claim 66, wherein said side walls extend upwardly a substantial length from said base thereby forming a bowl-shaped container for receiving food, said side walls being arced inwardly.

68. A domed cover made of a transparent material for engaging and covering a catering container, comprising:

a top;

a plurality of cover walls extending downwardly from said top, each of said plurality of cover walls arcing outwardly and being free of structural ribs;

a plurality of indentations adjacent said cover walls for engaging said catering container and transferring forces thereto, one of said plurality of indentations being positioned between adjacent ones of said plurality of cover walls;

a plurality of cover stiffening bars, one of said plurality of cover stiffening bars being disposed between and joining adjacent ones of said plurality of cover walls, each of said plurality of cover stiffening bars being free of structural ribs and projecting downwardly from said top; and a flange extending around and attached to lower portions of said cover wall and defining a hexagonal periphery, said flange having means for detachably connecting said domed cover to said catering container, said detachable connecting means being independent of said plurality of indentations.

69. A domed cover for engaging and covering a catering container, comprising:

a lower portion having a polygonal periphery with projecting comer joints, each of said projecting corner joints being obtuse;

a top;

a plurality of cover walls extending downwardly from said top toward said lower portion; and a plurality of cover stiffening bars, one of said plurality of cover stiffening bars being disposed between and joining adjacent ones of said plurality of cover walls, each of said cover stiffening bars extending across one of said projecting corner joints and being in relative non-alignment with said adjacent ones of said plurality of cover walls, said plurality of cover walls and said plurality of cover stiffening bars circumscribing said top, said plurality of cover walls being in "n" number, said plurality of cover stiffening bars being "n" in number, an interior angle at which each of said plurality of cover stiffening bars meets said adjacent one of said plurality of cover walls being substantially greater than 90°.

70. The domed cover of claim 69, wherein said plurality of cover walls are free of vertical structural ribs.

71. The domed cover of claim 70, wherein said plurality of cover walls are free of any structural ribs.

72. The domed cover of claim 69, wherein said plurality of cover stiffening bars are free of any structural ribs.

73. The domed cover of claim 69, wherein each of said plurality of cover walls is wider than each of said plurality of cover stiffening bars.

74. The domed cover of claim 69, wherein said lower portion includes a flange for defining said polygonal periphery.

75. The domed cover of claim 69, further including a plurality of indentations for mating with corresponding portions of said catering container to transfer forces therebetween.

76. The domed cover of claim 75, wherein said plurality of indentations are discrete structures that are spaced from each other by a predetermined distance.

77. A domed cover for engaging and covering a catering container, comprising:

a lower portion having a polygonal periphery with projecting corner joints, each of said projecting corner joints being obtuse;

a top;

a plurality of cover walls extending downwardly from said top toward said lower portion;

a plurality of cover stiffening bars, one of said plurality of cover stiffening bars being disposed between and joining adjacent ones of said plurality of cover walls, each of said cover stiffening bars extending across one of said projecting corner joints and being in relative non-alignment with said adjacent ones of said plurality of cover walls;

a plurality of discrete indentations that are spaced from each other by a predetermined distance, said plurality of discrete indentations for mating with corresponding portions of said catering container; and means for detachably connecting said domed cover to said catering container, said detachable connecting means being independent of said plurality of discrete indentations.

* * * * *

UNITED STATES PATENT AND TRADEMARK OFFICE

CERTIFICATE OF CORRECTION

PATENT NO : 5,984,130
DATED : November 16, 1999
INVENTOR(S) : Hayes et al.

It is certified that error appears in the above-identified patent and that said Letters Patent is hereby corrected as shown below:

Column 15, line 30: Replace "in 'n'" with -- "n" in --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*